United States Patent [19]

Shira

[11] Patent Number: 4,992,236

[45] Date of Patent: Feb. 12, 1991

[54] METHOD OF MAKING A GOLF CLUB HEAD AND THE ARTICLE PRODUCED THEREBY

[76] Inventor: Chester S. Shira, 3645 Ruffin Rd., Ste. 125, San Diego, Calif. 92123

[21] Appl. No.: 465,831

[22] Filed: Jan. 16, 1990

[51] Int. Cl.[5] ..... B22F 3/26

[52] U.S. Cl. ..... 419/28; 419/29; 419/27; 75/228; 273/169; 273/170; 273/171; 273/167 F; 273/167 H; 273/77 A

[58] Field of Search ..... 273/169, 170, 171, 167 F, 273/167 H, 77 A; 419/27, 28, 29; 75/228

[56] References Cited

U.S. PATENT DOCUMENTS

| | | | |
|---|---|---|---|
| 1,543,691 | 6/1925 | Beat | 273/172 |
| 2,846,228 | 8/1958 | Reach | 273/170 |
| 3,578,332 | 5/1971 | Caldwell | 273/164 |
| 3,845,960 | 11/1974 | Thompson | 273/171 |
| 3,955,820 | 5/1976 | Cochran et al. | 273/167 |
| 3,961,796 | 6/1986 | Thompson | 273/167 |
| 4,145,052 | 3/1979 | Janssen et al. | 273/171 |
| 4,326,326 | 4/1982 | MacDonald | 29/428 |
| 4,502,687 | 3/1985 | Kochevar | 273/171 |
| 4,667,963 | 5/1987 | Yoneyama | 273/169 |
| 4,768,787 | 9/1988 | Shira | 273/175 |
| 4,793,616 | 12/1988 | Fernandez | 273/167 |
| 4,824,116 | 4/1989 | Nagamoto et al. | 273/171 |

FOREIGN PATENT DOCUMENTS

| | | | |
|---|---|---|---|
| 64-02675 | 1/1989 | Japan | 273/171 |
| 1232651 | 5/1971 | United Kingdom | 273/171 |
| 2174009 | 10/1986 | United Kingdom | 273/167 F |

OTHER PUBLICATIONS

Spalding Executive Clubs Advertisement, Golf Digest, May; 1972, p. 21.

*Primary Examiner*—Stephen J. Lechert, Jr.
*Assistant Examiner*—Leon Nigohosian, Jr.
*Attorney, Agent, or Firm*—John L. Gray

[57] ABSTRACT

A method of making a golf club head and golf club heads produced by said method which involves filling a mold with material selected from the group consisting of metal powders, castings, wrought metal, and green compact metal powders and combinations thereof so as to achieve the desired properties in the particular areas of the club head, compressing the material in the mold to form a green compact of the material, removing the green compact of the material from the mold land then heating the green compact to an elevated temperature to form a sintered product. Thereafter, the sintered product may be further heated under pressure to improve its density.

24 Claims, 2 Drawing Sheets

METHOD OF MAKING A GOLF CLUB HEAD AND THE ARTICLE PRODUCED THEREBY

BACKGROUND OF THE INVENTION

Ideally, golf club heads should be made with selective perimeter or heel, head, and toe weighting, adjustable densities, extended-life ball-striking surfaces, specific sonic characteristics, high friction surfaces, high ductility hosel and other desired mechanical properties, and an adjustable center of gravity.

At the present time such characteristics are achieved with varying degrees of success by the following: perimeter weighting and head and toe weighting are commonly used in forged and in investment cast clubs and desired weight distribution is achieved by shaping the club head to produce a cavity in the back of the club thus producing a complex shape known as cavity backed irons. In some cases, particularly putters, a cavity is provided in back of the club which is later filled with higher density metals by lead casting or gluing in place higher density metals. The resultant cavity is difficult to finish to a smooth surface by grinding and polishing and thus the club heads are not generally finished to a high polish. The raw, unfinished look of the cavity back is not attractive or well accepted by many skilled players but the improved performance provided by the cavity back and perimeter weighting is recognized as a benefit by players of all skill levels.

Adjustable densities in club heads are not possible using current forging and casting practices. The only method of changing density is to substitute one alloy for another, or by utilizing one or more weight ports where higher density disks or powders may be positioned and held in place by mechanically fastening or glue-bonding the enclosures in place. Additives of different density alloys to other primary alloys in the casting process will only produce a third alloy or a non- compatible mixture of metallic elements not suitable for use as golf club heads.

Extended-life ball-striking surfaces are presently produced by metal spraying a hard deposit on the surface of cast or forged clubs. and flame or case hardening the cast or forged clubs Additionally, ion implantation techniques may be used to harden a previously roughened surface. This is also accomplished by the teaching of U.S. Pat. No. 4,768,787, Shira, by producing a composite of hard particles in a softer metal matrix on the surface of the club. Extended life ball striking surfaces which are produced by hardening are temporary because of the thin surface developed by conventional techniques. The impact loading of the surface of golf clubs tends to peen and burnish the softer matrix material under the hard surface, thus destroying the desired roughness of the hardened surface material. Hard surfaces produced by flame spraying or plating a hard material on the surface of the golf club are often thin and quite brittle and tend to flake and peel under various service conditions.

Desired sonic characteristics are produced by selecting an alloy that, when properly heat treated, provides a sound when striking the ball that is deemed by experts to be desirable. The sound most desired is that of a ball striking a soft iron-carbon alloy commonly used for forged club heads. The hardness of this alloy is approximately Rockwell B85, a relatively soft, low-strength alloy. Clubs made of alloys with similar hardness levels are easily nicked and damaged by striking rocks and other hard objects, and wear rapidly by abrasion when used in sand traps and loam-type soils.

High friction surfaces are produced by sand blasting, flame spraying, and also by the use of hard particles in a softer metal matrix as is taught in U.S. Pat. No. 4,768,787, Shira.

At the present time, desirable properties in selected areas of a club head, such as a high ductility hosel, may be achieved by local heat treating using current technology but no manufacturers are known even to be using this technique.

Using present technology, the center of gravity of presently manufactured clubs is adjusted only by changing the shape, size and location of various portions of the club head or by utilizing suitably positioned weight ports holding appropriate dense materials.

SUMMARY OF THE INVENTION

The present invention attains any of the desirable characteristics above mentioned, either alone or in combination, by the use of various powder metallurgy processes utilizing high- and low-density materials, hard materials, and ductile materials for various portions of the club head to create the desired effects. Club heads are produced using blended metal powders, inserts of cast or wrought metal or green compacts of metal followed by powder metallurgy fabrication processes.

It is therefore an object of this invention to produce a golf club head using a powder metallurgy process which golf club head will have the desirable characteristics for the specific application intended.

It is a further object of this invention to provide a method of manufacturing such a golf club head with a minimum of production steps.

These, together with other objects and advantages of the invention will become more readily apparent to those skilled in the art when the following general statements and descriptions are read in the light of the appended drawings.

DETAILED DESCRIPTION OF THE INVENTION

In practicing the method constituting part of the invention herein, a suitable mold in the shape of a golf club head is prepared. Usually these molds are made of rubber or similar elastomeric materials. Sometimes they are disposable, sometimes they may be reused. The mold is filled with the appropriate materials. In some cases this is merely metal powders of different densities. In some cases it is a combination of metal powders, castings, or wrought metal, or green compacts of metal powders. When the right combination of materials has been placed in the mold in the proper locations, the mold is compressed at a pressure sufficient to form a green compact of the material in the mold. This compression takes place at ambient temperature and usually involves pressures up to 100,000 psi. When the green compact is removed from the mold it can be trimmed and otherwise finished prior to the next step. The green compact usually has achieved a density of about 85 percent to 95 percent of the theoretical density of the materials therein.

After the green compact has been suitably trimmed, etc., if necessary, it is then heated at an elevated temperature to achieve sintering of the materials contained therein. The particular temperature utilized will depend upon the materials involved. Temperatures as high as 2250° F. are oftentimes used. The sintered product usually has achieved a density of approximately 90 percent to 95 percent of the theoretical density and the golf club head may be used in this condition. However, if desired, an additional step is performed during which the sintered product is heated while under pressure. Pressures up to approximately 60,000 psi are used and temperatures up to 2250° F. may be used. The temperature and pressure selected are based on the mutual diffusion rates and deformation characteristics of the materials being processed. The resultant product has nearly 100 percent of the theoretical density of the materials contained therein.

In addition to simple powder metallurgy processes of pressing and sintering, the following processes can be used to fabricate golf clubs made in accordance with this invention: (a) Press, Sinter, and Hot Forge; (b) Cold Isostatic Press followed by Hot Isostatic Press; (c) Cerrocom; (d) Omnidirectional Compaction; (e) Spray Deposition; (f) Gas Isostatic Forging and other modifications.

Specific combinations of materials utilizing these methods are shown in the accompanying figures.

Figure 1:
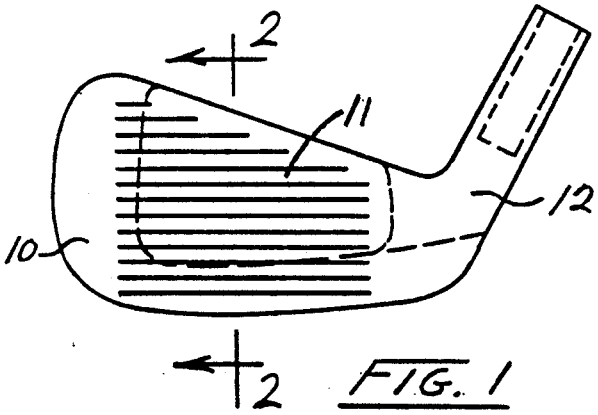
FIG. 1 is a golf club head which illustrates the use of applicant's invention in effecting desirable perimeter weighting.

Referring now more particularly to FIG. 1, perimeter weighting of a golf club head is shown. This is achieved by selecting metal powders as follows: A high-density alloy such as tungsten for the toe, heel, and sole of the club are shown at 10 in the area separated by the dotted line. Such a tungsten-rich alloy might have a density of 0.697 pounds/cu.in. A moderate density stainless steel alloy for the face of the club shown at 11, such as 17-4PH stainless steel having a density of 0.290 pounds/cu.in. might be used. For the hosel of the club a different stainless steel alloy as shown at 12 might be used. For example, 304L stainless steel having a density of 0.290 pounds/cu.in. could be used.

Figure 2:
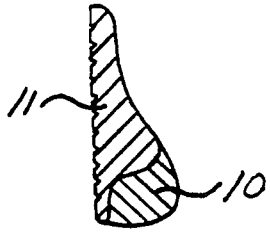
FIG. 2 is a section of FIG. 1 on plane 2—2.

Configuration of such a club is shown both in FIGS. 1 and 2. The benefits achieved by this combination of densities are a degree of perimeter weighting not possible by current practices and a smooth back without a cavity thus avoiding attendant finishing problems and undesired appearance. Additionally, the hosel has properties that permit bending to adjust loft and lie of the club without fear of breaking, as is not true of many current materials of construction. Other powdered materials may be added to component powders to match expansion coefficients to avoid distortion of the club head during heating or cooling operations.

Figure 3:
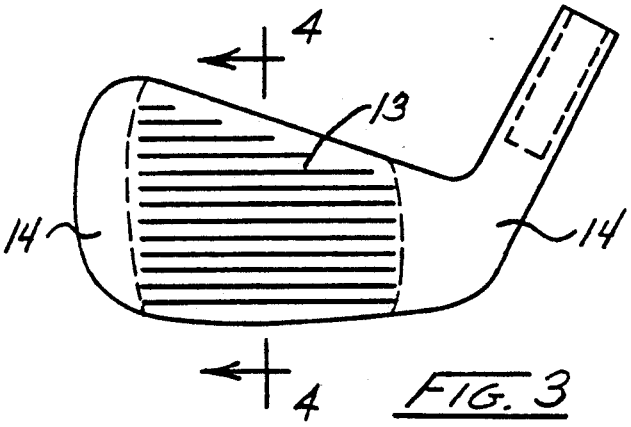
FIG. 3 is a drawing of a golf club head having a wear resistant surface.
Figure 4:
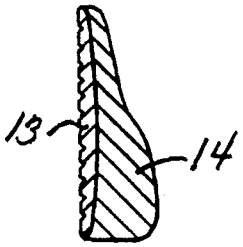
FIG. 4 is a section of FIG. 3 on plane 4—4.

Referring now to FIG. 3, a wear-resistant alloy such as Deloro 50 is shown at 13 for the ball striking surface while the remainder of the club is made of 304L stainless steel as shown at 14. The high carbide content of Deloro 50 makes it both extremely abrasion resistant as well as having a high-friction surface when portions of the matrix alloy are removed by wear or sand blasting after processing. The same club head is shown in FIG. 4. The surface 13 of the club head may also be made in accordance with the teachings of U.S. Pat. No. 4,768,787, Shira.

In order to achieve desired sonic characteristics but with the ball-striking face made of a harder material selected for resistance to nicking and deformation when hitting rocks, pebbles, roots and the like, the portion 13 of the club head shown in FIG. 3 may be made from a hardened 174PH stainless steel alloy, for example, and the balance of the club head 14 may be made of material such as 316L stainless steel.

Figure 5:
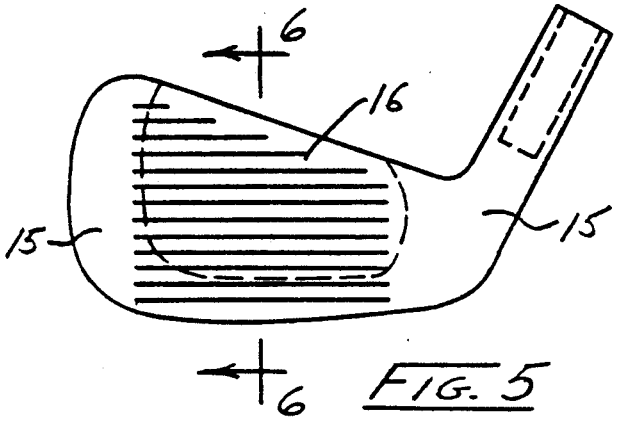
FIG. 5 shows a golf club head having a combination of desirable perimeter weighting and a high friction surface face.
Figure 6:
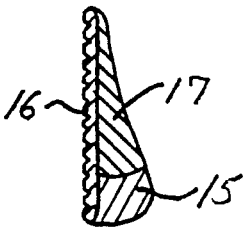
FIG. 6 is a section of FIG. 5 on plane 6—6.

The club head shown in FIG. 5 is somewhat similar to the club head shown in FIG. 3 except that it combines the features of perimeter weighting and a high-friction face. The portion of the club head 15 may be made from a copper alloy such as C729000, which is a spinodal alloy of copper containing 15 percent nickel and 8 percent tin, having a density of 0.320 pounds/cu.in.. The ball-striking area 16 can be made of the same alloy containing 15 percent by volume of tungsten carbide particles (30 micron size) and the back area of the club shown at 17 in FIG. 6 may be made of a 6AL-4V titanium alloy. The portion of the club head shown at 16 is produced by the teachings of U.S. Pat. No. 4,768,787, Shira. By making the back center of the club head of a lowdensity 6AL-4V titanium alloy, greater perimeter weighting by the higher density of alloy C729000 is realized.

Figure 7:
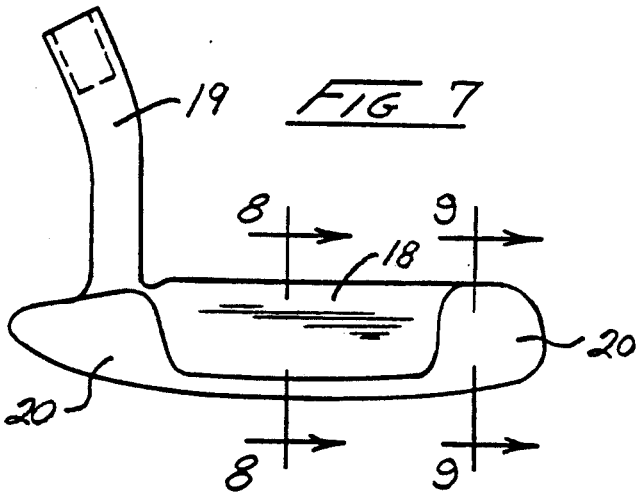
FIG. 7 shows a golf club putter which has been perimeter weighted to achieve maximum desirable characteristics.
Figure 8:
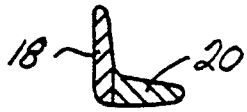
FIG. 8 is a section of FIG. 7 on plane 7—7.
Figure 9:
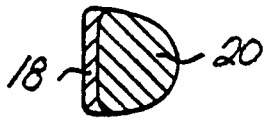
FIG. 9 is a section of FIG. 7 on plane 9—9.

Referring now to FIG. 7, a putter head is shown with tungsten both in the toe and heel of the club with a copper alloy center section and neck of the club. The copper alloy is shown at 18 and 19 in the hosel using an alloy having a density of 0.320 pounds/cu.in., while the tungsten alloy is shown at 20 having a density of 0.697 pounds/cu.in..

This combination produces an inertia substantially higher than present putters which use lead, or simply large sections of the primary alloy as an insert weight in the head and toe of die cast club heads.

Figure 10:
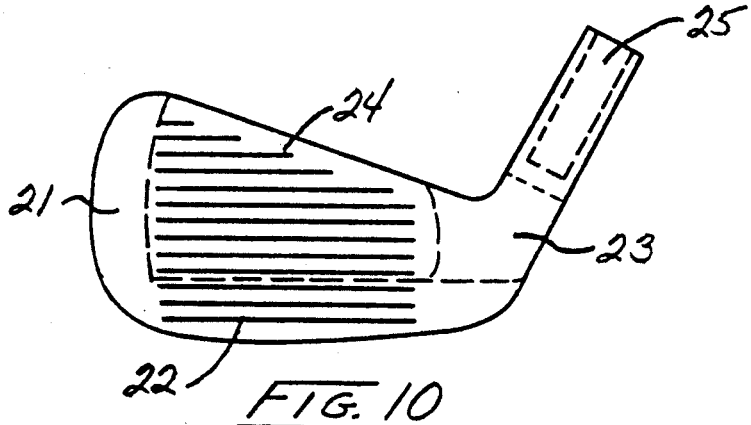
FIG. 10 shows a club head with a toe, heel, and sole weighting.

FIG. 10 shows a club head with the toe 21, the sole 22, and the heel 23 made from a blend of tungsten and copper alloy. The portion shown at 24 may be made of copper alloy C72900, while the hosel 25 is 100 percent copper alloy. The overall weight of the club head may be modified by simply changing the ratio of tungsten to copper in portions 21, 22, and 23 of the club head. The center of gravity may be adjusted by changing the ratio of tungsten to copper in one or several selected sections For example, a mix of 90 percent tungsten could be used in area 21 with a mix of 70 percent tungsten in areas 22 and 23 to shift the center of gravity to the toe of the club. Use of higher ratios of tungsten in area 22 will shift the center of gravity downward.

Figure 11:
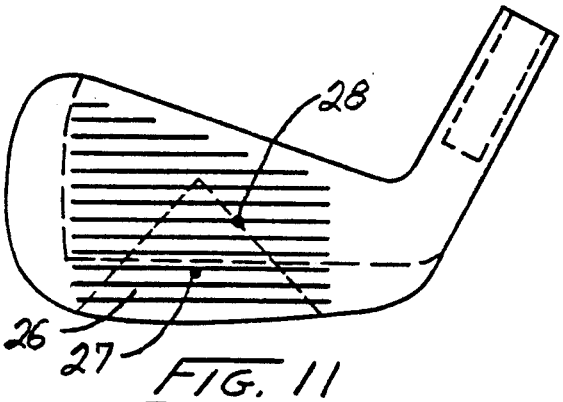
FIG. 11 is a club head where the center of gravity has been shifted to the ideal location.

Referring now more particularly to FIG. 11, the area inside of the triangle designated 26 is a pattern of impact points for shots most frequently hit. Point 27 ideally should be the center of gravity of the club head. Point 28 is the location of the center of gravity for presently manufactured golf clubs. Use of high-density alloys in the sections 22 and 21 as shown in FIG. 10 and corresponding sections in FIG. 11 enables shifting of the center of gravity from point 28 to point 27.

The ratio of various density particles to construct golf clubs according to this invention, is not restrictive and can vary to as little as one percent of high-density or other specialty powders to as much as 95 percent to achieve various design objectives.

When perimeter weighting is used to adjust the location of and to enlarge the sweet spot, the ratio, as is shown in FIG. 7, of dense powders might be as high as 90 percent with the lower density powder used only in the center of the hitting surface. To move the center of gravity to point 27 in FIG. 11, the ratio, by weight, of dense powder to the total weight is approximately 75 percent.

Ratios of high-density powders, on the other hand, might be as low as one percent to 25 percent if used to adjust overall density of club heads to provide desired swing weights of club heads manufactured from the same mold. For example, if a given mold will produce a club head weight of 308 grams when filled with 304L stainless steel powder (density 0.290 grams /cu.in.) then replacement of five percent of the 304L powder with tungsten powder (density 0.697 grams/cu.in.) will result in a club head that will weigh 329.6 grams, an increase of seven swing weight points on the Lorythmic swing weight scale. Each three grams causes a change of one swing weight (i.e., from D-2 to D-3 on the Lorythmic scale). Thus, if a change of only one swing weight point is desired, less than one percent of tungsten powder would be used. Current practice requires various swing weights to be produced from different molds and/or by additional grinding after production to provide proper swing weight, both methods having a significant impact on cost. With applicant's method, one mold design can be utilized to produce the entire family of weights and swing weights desired for children, women, and various men's golf clubs.

Alloys and pure metals that are structurally useful for the method described in this application can be grouped into three categories of low-density, medium-density, and high-density. The materials are set forth in the following Table 1.

TABLE I

| LOW-DENSITY (#/Cu In) | | MEDIUM-DENSITY (#/Cu In) | | HIGH-DENSITY (#/Cu In) | |
|---|---|---|---|---|---|
| Magnesium | (.065) | Iron | (.284) | Copper | (.323) |
| Aluminum | (.097) | Stainless | (.290) | Silver | (.374) |
| Titanium | (.160) | NI Base | (.300) | Molybdenum | (.369) |
| Zinc | (.240) | Cobalt Base | (.310) | Lead | (.410) |
| | | | | Palladium | (.434) |
| | | | | Tantalum | (.600) |
| | | | | Uranium | (.689) |
| | | | | Tungsten | (.697) |
| | | | | Gold | (.698) |
| | | | | Platinum | (.775) |

Thus, it will be seen that golf club heads may be created having a variety of desirable characteristics. One of these is a high inertia design which is produced by placing high-density metals and alloys as far from the centroid of the golf club as is possible. Center portions of the club are made with lower density materials. A high inertia is desired to prevent the golf club from twisting when striking a golf ball on other than the "sweet spot" or center of gravity of the club. The formula, $I=MR^2$, where "I" is the product of inertia, "M" is the mass, and "R" is the distance from the center of gravity, shows how greatly inertia increases with increases in mass and the distance "R". The greater mass of high density materials added to the extreme outer edges of the club utilize a larger "R" and thus a significantly higher product of inertia.

Long life surface can be achieved by using this method. Alloys that provide a long life surface for a golf club often do not have mechanical or sonic properties that are acceptable in golf club construction. Ductility and fracture toughness are not adequate to permit bending the hosel and the striking of hard objects. Thus by using wear resistant particles only in the ball striking area of the golf club, in accordance with U.S. Pat. No. 4,768,787, Shira, and more ductile, fracture safe alloys in other portions of the club, long service life can be achieved without sacrificing other desirable features.

New golf clubs have grooves with sharp radii and a surface roughened by sand blasting. Rough surface and grooves enable the player to put back spin on the shots and to provide more accuracy when hitting balls to a green. Normal wear and tear reduce the effectiveness of both sand blasting and grooves wear rapidly in as little as a few rounds of golf. Many techniques exist to improve wear resistance of metals but most of these require adding some element to the surface of the club and this is generally not allowed by the USGA Rules of Golf. Many wear resistant metals could be used to manufacture golf clubs but these are generally quite expensive and the alloys may not have adequate mechanical properties to permit adjustment of loft and lie. Use of wear resistant powdered metals only in the ball striking surface area of the club is possible while utilizing other powdered metal alloys in the balance of the club to satisfy design requirements. Blending of alloys in this manner is permitted by the Rules of Golf and is practical using the family of powdered metals fabrication technology as well as the teachings of U.S. Pat. No. 4,768,787, Shira.

In order to achieve selected sonic characteristics alloys with high hardness, which would create a high pitched sound when striking a golf club which is not acceptable to many golfers, may be used in certain portions of the club head for greater wear resistance, better finishes and resistance to nicking and scratching, while softer, vibration-absorbing metal or alloy in certain portions of the club head where the ball strikes the club head, will result in a lower frequency sound considered much more acceptable.

The ideal high friction surface is set forth in U.S. Pat. No. 4,768,787, Shira, and overcomes the problem of using a material having high friction characteristics which might not have the proper mechanical properties to be used in all portions of the club head. Also, the cost would be unnecessarily high. Use of high friction surfaces in all areas of the club head also make finishing, grinding, and polishing overly expensive.

By using applicant's invention, high ductility alloys may be used in the hosel or other portions of the club where desired, such as in the hosel where bending to adjust loft and lie of the club is desired. By using the process of this invention, such desired characteristics can be incorporated into the club head without sacrificing wear resistance, sonic characteristics, surface friction, or any other desirable feature of the club.

As indicated, the center of gravity of present clubs is not located where balls are most frequently hit by golfers. By utilizing applicant's invention the desired location of the sweet spot and the location of the center of gravity can be made identical, as discussed with respect to FIG. 11, so that this desirable result is achieved. By making club heads using applicant's invention, club heads are obtained that result in straighter shots, more repeatable precise and predictable golf shots, longer shots, a more streamlined design, a reduction of the skill level required to produce accurate golf shots, a golf head that is easier to grind, polish and clean after fabrication, a club head that has desired sonic characteristics, a golf head that does not have sharp edges and corners that injure golfers' hands and body parts, and a golf head where swing weight can be varied by simply adding a higher or lower ratio of the more dense powder before the initial pressing operation. Fewer dies are required to produce different swing weights with various materials of construction since adjustments can be made by varying powder ratios, and a club head is produced with a high ductility hosel that can easily be bent to adjust the loft and lie of the club.

Thus it will be seen that the invention of applicant can be used to produce a great variety of desirable characteristics in golf club heads as dictated by the needs of the players.

While this invention has been described in its preferred embodiment, it is to be appreciated that variations therefrom may be made without departing from the true scope and spirit of the invention.

I claim:

1. A method of making a golf club head which comprises filling a mold having the shape of a gold club head with metal powders, said mold optionally containing inserts made from a material selected from the group consisting of castings, wrought metal and green compacts of metal powders and combinations thereof, compressing said material in said mold at a pressure sufficient to form a green compact of said material, removing said thus formed green compact of said material from said mold and then heating said material in said green compact to an elevated temperature sufficient to form a sintered product of said material in said green compact.

2. The method of claim 1 wherein said sintered product is further heated under pressure whereby the density of said sintered product is increased.

3. The method of claim 2 wherein said step of further heating under pressure is hot forging.

4. The method of claim 1 wherein the step of compressing said material in said mold is performed by cold isostatic pressing.

5. The method of claim 4 wherein said sintered product is further treated by hot isostatic pressing whereby the density of said sintered product is increased.

6. A method of making a golf club head which comprises filling a mold having the shape of a golf club head with metal powders, said mold optionally containing inserts made from a material selected from the group consisting of castings, wrought metal and green compacts of metal powders and combinations thereof, surrounding said material in said mold with a wear-resistant granular material and compressing said granular material at a high temperature sufficient to form a metal golf club head.

7. A method of making a golf club head which comprises filling a mold having the shape of a gold club head with metal powders, said mold optionally containing inserts made from a material selected from the group consisting of castings, wrought metal and green compacts of metal powders and combinations thereof, said mold being made of a material which will become plastic at elevated temperatures, compressing said mold at a pressure sufficient to form a metallic golf club head, and removing said mold from said golf club head.

8. A method of making a golf club head which comprises filling a mold having the shape of a golf club head in a chamber with metal powders formed within said chamber, compressing said material in said mold at a pressure sufficient to form a green compact of said material, removing said thus formed green compact of said material from said mold and then heating said material in said green compact to an elevated temperature sufficient to form a sintered product of said material in said green compact.

9. The method of claim 8 wherein said sintered product is further heated under pressure whereby the density of said sintered product is increased.

10. A method of making a golf club head which comprises filling a mold having the shape of a golf head with metal powders, said mold optionally containing inserts made from a material selected from the group consisting of castings, wrought metal and green compacts of metal powders and combinations thereof, placing said mold in a chamber and subjecting said mold to a short burst of very high pressure in said chamber, and removing said thus formed golf club head from said mold.

11. The method of claim 1 wherein said material in said mold is compressed at ambient temperature to a pressure sufficient to achieve a density of between approximately 85 percent and 95 percent of the theoretical density of said material.

12. The method of claim 1 wherein said material in said green compact is heated to a temperature sufficient to form a sintered product having 90 percent to 95 percent of the theoretical density of said material.

13. The method of claim 11 wherein said material in said green compact is heated to a temperature sufficient to form a sintered product having 90 percent to 95 percent of the theoretical density of said material.

14. The method of claim 2 wherein said sintered product is heated to a temperature sufficient to provide densification and diffusion necessary to achieve a suitably dense and metallurgically sound product.

15. The method of claim 14 wherein pressure up to 60,000 psi is applied to said sintered product.

16. The method of claim 1 wherein said mold is filled with a heavier alloy in the toe, sole, and heel of the club head and the remainder of the club head is filled with a lighter alloy.

17. The method of claim 1 wherein said mold is filled with a wear resistant alloy in the face of the club head and the remainder of the club head is made of a different alloy.

18. The method of claim 1 wherein said mold is filled with a heavy alloy in the toe, sole, and heel of the club head and the face of the club head is filled with a wear resistant material.

19. The method of claim 1 wherein said mold is filled with sufficient heavy alloy in the toe and sole area of the club head so as to move the center of gravity of the club head to the center of the most frequent impact point of the club head.

20. The method of claim 1 wherein said mold is filled with a heavy alloy in the toe, sole, and heel of the club head and the face of the club head is filled with a material having desirable sonic characteristics.

21. The method of claim 16 wherein said heavier alloy is a tungsten-rich alloy.

22. The method of claim 18 wherein said heavy alloy is a tungsten-rich alloy.

23. The method of claim 19 wherein said heavy alloy is a tungsten-rich alloy

24. The method of claim 20 wherein said heavy alloy is a tungsten-rich alloy.

* * * * *